US011540588B1

(12) United States Patent
Dananberg et al.

(10) Patent No.: US 11,540,588 B1
(45) Date of Patent: Jan. 3, 2023

(54) FOOTWEAR INSOLE

(71) Applicant: HBN SHOE, LLC, Salem, NH (US)

(72) Inventors: Howard Dananberg, Stowe, VT (US); Brian G. R. Hughes, San Antonio, TX (US)

(73) Assignee: HBN SHOE, LLC, Salem, NH (US)

( * ) Notice: Subject to any disclaimer, the term of this patent is extended or adjusted under 35 U.S.C. 154(b) by 0 days.

(21) Appl. No.: 17/535,275

(22) Filed: Nov. 24, 2021

(51) Int. Cl.

| | |
|---|---|
| ***A43B 7/14*** | (2022.01) |
| ***A43B 3/12*** | (2006.01) |
| ***A43B 17/00*** | (2006.01) |
| ***A43B 7/1445*** | (2022.01) |
| ***A43B 7/1405*** | (2022.01) |
| ***A43B 7/1415*** | (2022.01) |

(52) U.S. Cl.
CPC ..... *A43B 3/128* (2013.01); *A43B 7/14* (2013.01); *A43B 7/1405* (2013.01); *A43B 7/1415* (2013.01); *A43B 7/1445* (2013.01); *A43B 17/00* (2013.01)

(58) Field of Classification Search
CPC ..... A43B 7/14; A43B 7/1405; A43B 7/1415; A43B 7/1445
USPC ..... 36/180, 174, 144
See application file for complete search history.

(56) References Cited

U.S. PATENT DOCUMENTS

| | | | | |
|---|---|---|---|---|
| 73,924 A | | 1/1868 | Pickett | |
| 975,576 A | | 11/1910 | Sexton | |
| 1,055,768 A | | 3/1913 | Levee et al. | |
| 1,137,092 A | | 4/1915 | Sharp | |
| 1,144,291 A | * | 6/1915 | Boyer | A43B 7/144 36/43 |
| 1,210,066 A | | 12/1916 | Hara | |
| 1,287,810 A | | 12/1918 | Wojteck | |
| 1,387,952 A | | 8/1921 | Steinbrecher | |
| 1,550,715 A | | 6/1923 | Stout | |
| 1,480,234 A | | 1/1924 | Wedd | |
| 1,503,764 A | | 8/1924 | Nickerson | |
| 1,544,625 A | | 7/1925 | Austin | |
| 1,557,312 A | | 10/1925 | Lelyveld | |
| 1,728,243 A | | 9/1929 | Marshalek | |

(Continued)

FOREIGN PATENT DOCUMENTS

| | | | |
|---|---|---|---|
| CL | 199601035 | 2/1997 | A43B 17/00 |
| CN | 1233943 | 11/1999 | A43B 13/40 |

(Continued)

OTHER PUBLICATIONS

U.S. Appl. No. 15/057,925, filed Mar. 1, 2016.

(Continued)

*Primary Examiner* — Marie D Bays
(74) *Attorney, Agent, or Firm* — Hayes Soloway P.C.

(57) ABSTRACT

A trim to fit insole for insertion into a shoe has a raised metatarsal pad on the insole upper surface, wherein the raised metatarsal pad has a first region rising at a slope inboard from a medial edge of the insole board, and configured to underlie the first metatarsal head of the wearer, a second, raised top surface region configured to underlie the second to fourth metatarsal shafts of the wearer, and a third region sloping downward towards the lateral edge of the insole configured to underlie the fifth metatarsal shaft of the wearer, wherein all three regions cooperate to evert the first metatarsal and to invert the fifth metatarsal of the wearer.

14 Claims, 13 Drawing Sheets

(56) References Cited

U.S. PATENT DOCUMENTS 1,760,300 A 5/1930 Donovan ..... 36/43
1,777,855 A 10/1930 Oblak ..... 36/43
1,819,539 A 8/1931 Bringardner
RE18,237 E 10/1931 Messler
1,827,044 A 10/1931 Simon
1,828,086 A 10/1931 Tweedie
1,847,287 A 3/1932 White
1,847,973 A 3/1932 Morton
1,864,999 A 6/1932 Gluckman
1,907,997 A 5/1933 Nickerson
1,957,695 A 5/1934 Chiapetta ..... 36/71
1,960,418 A 5/1934 Schaller ..... 36/71
1,992,081 A 2/1935 Madinger ..... 36/71
2,008,207 A 7/1935 Greenberg ..... 36/71
2,029,409 A 2/1936 Brand ..... 36/71
2,034,463 A 3/1936 Dvlinsky ..... 36/71
2,046,732 A 7/1936 Fein ..... 36/43
2,055,072 A 9/1936 Everston ..... 36/28
2,081,474 A 5/1937 Burns ..... 36/71
2,082,891 A * 6/1937 Hubbard ..... A43B 7/1464 33/3 R
2,088,263 A 7/1937 Grouven ..... 36/8.5
2,092,910 A 9/1937 Daniels ..... 36/71
2,097,759 A 11/1937 Ehrlich ..... 36/71
2,119,807 A 6/1938 Farley ..... 36/71
2,246,944 A 1/1939 Larkin ..... 36/71
2,156,532 A 5/1939 Greider ..... 36/2.5
2,161,565 A 6/1939 Freda ..... 36/71
2,221,202 A 11/1940 Ratcliff ..... 36/71
2,252,936 A 8/1941 Leydecker ..... 12/142
2,255,100 A 9/1941 Brady ..... 36/71
2,304,384 A 12/1942 Stemmons ..... 36/71
2,346,279 A 4/1944 Stritter ..... 36/44
2,379,000 A 6/1945 Gould ..... 36/8.5
D143,642 S 1/1946 Bouthillette ..... D7/5
2,411,901 A * 12/1946 Silver ..... A43B 7/1415 36/145
2,413,534 A 12/1946 Watson ..... 36/71
2,423,622 A 7/1947 Samblanet ..... 36/71
2,424,107 A 7/1947 McCahan ..... 36/71
2,460,493 A 2/1949 Diamant ..... 36/8.5
2,468,887 A * 5/1949 Malouf ..... A43B 7/143 36/178
2,475,417 A * 7/1949 Wysowski ..... A43B 7/1445 36/71
2,486,653 A * 11/1949 Hukill ..... A43B 7/1445 36/141
2,505,032 A 4/1950 De Voos ..... 36/11.5
2,588,317 A 6/1951 Schwartz ..... 36/76
2,567,028 A * 9/1951 Rapisarda ..... A43B 7/1445 36/173
2,589,163 A * 3/1952 Tieman ..... A43B 7/142 36/180
2,628,440 A 2/1953 Leydecker ..... 36/71
2,658,288 A 11/1953 Scholl ..... 36/44
2,710,462 A * 6/1955 Swadburgh ..... A43B 7/145 36/141
2,760,281 A * 8/1956 Cosin ..... A43B 7/14 36/154
2,814,133 A 11/1957 Herbst ..... 36/71
2,821,032 A 1/1958 Helfet ..... 36/71
2,826,834 A 3/1958 Ratcliff ..... 36/71
2,828,555 A 4/1958 Ledos ..... 36/71
2,863,231 A * 12/1958 Jones ..... A43B 7/1445 36/174
2,897,611 A 8/1959 Schaller ..... 36/30
2,909,854 A 10/1959 Edelstein ..... 36/8.5
2,917,849 A 12/1959 Scholl ..... 36/71
2,928,193 A 3/1960 Kristan ..... 36/71
2,961,780 A 11/1960 McManus ..... 36/71
3,058,240 A 10/1962 Osgood ..... 36/91
3,068,872 A 12/1962 Brody ..... 128/595
3,084,695 A 4/1963 O'Donnell ..... 128/615
3,099,267 A 7/1963 Cherniak ..... 128/615
3,165,841 A 1/1965 Rollman ..... 36/2.5
3,187,069 A 6/1965 Pincus et al. ..... 264/45
3,233,348 A 2/1966 Gilkerson ..... 36/44
3,309,797 A 3/1967 Poitras ..... 36/80
3,333,353 A 8/1967 Garcia ..... 36/68
3,416,245 A 12/1968 Ferreira ..... 36/44
3,449,844 A 6/1969 Spence ..... 36/44
3,530,489 A 9/1970 Appleton ..... 36/44
3,591,882 A 7/1971 Pearsall ..... 12/146
3,638,336 A 2/1972 Silverman ..... 36/44
3,643,353 A 2/1972 Weight ..... 36/44
3,646,692 A 3/1972 Glogg ..... 36/2.5
3,680,162 A 8/1972 Glickman ..... 12/142
3,730,169 A 5/1973 Fiber ..... 128/2
3,781,231 A 12/1973 Janssen et al. ..... 260/2.5
3,832,793 A 9/1974 Siskin ..... 36/2.5
3,842,519 A 10/1974 Lapidus ..... 36/44
3,847,720 A 11/1974 Laberinti ..... 161/159
3,935,044 A 1/1976 Daly ..... 156/79
3,942,206 A 3/1976 Diamant ..... 12/142
4,003,146 A 1/1977 Meier et al. ..... 36/44
4,048,732 A 9/1977 Stix ..... 36/34
4,054,706 A 10/1977 Shapiro ..... 428/213
4,055,699 A 10/1977 Hsiung ..... 428/311
D246,551 S 12/1977 Hansjosten et al. ..... D2/320
4,073,024 A 2/1978 Stix ..... 12/142
4,084,333 A 4/1978 Del Vecchio ..... 36/43
4,101,704 A 7/1978 Hiles ..... 428/218
4,124,946 A 11/1978 Tomlin ..... 36/43
4,128,950 A 12/1978 Bowerman et al. ..... 36/30
4,137,654 A 2/1979 Hlavac ..... 36/119
4,168,585 A 9/1979 Gleichner ..... 36/95
4,187,621 A 2/1980 Cohen ..... 36/44
4,188,736 A 2/1980 Keller ..... 36/80
4,235,026 A 11/1980 Plagenhoff ..... 36/32
4,237,626 A 12/1980 Brown ..... 12/146 B
4,240,214 A 12/1980 Sigle et al. ..... 36/30
4,266,350 A 5/1981 Laux ..... 36/44
4,268,980 A 5/1981 Gudas ..... 36/43
4,272,899 A 6/1981 Brooks ..... 36/129
4,285,144 A 8/1981 Power ..... 36/44
4,291,428 A 9/1981 Anzani ..... 36/44
4,292,263 A 9/1981 Hanrahan et al. ..... 264/469.9
4,296,053 A 10/1981 Doerer et al. ..... 264/26
4,302,892 A 12/1981 Adamik ..... 36/31
4,307,521 A 12/1981 Inohara et al. ..... 36/31
4,316,335 A 2/1982 Giese et al. ..... 36/129
4,317,293 A 3/1982 Sigle et al. ..... 36/43
4,320,588 A 3/1982 Sottolana ..... 36/43
4,345,387 A 8/1982 Daswik ..... 36/43
4,346,205 A 8/1982 Hiles ..... 528/53
4,346,525 A 8/1982 Larsen et al. ..... 36/69
4,360,027 A 11/1982 Friedlander et al. ..... 128/581
4,364,189 A 12/1982 Bates ..... 36/31
4,367,599 A 1/1983 Diamant ..... 36/44
4,372,059 A 2/1983 Ambrose ..... 36/32
4,377,041 A 3/1983 Alchermes ..... 36/30
4,378,642 A 4/1983 Light et al. ..... 36/35
4,387,516 A * 6/1983 Laux ..... A43B 3/0078 36/43
4,398,357 A 8/1983 Batra ..... 36/30
4,408,402 A 10/1983 Looney ..... 36/43
4,418,483 A 12/1983 Fujita et al. ..... 36/28
4,435,910 A 3/1984 Marc ..... 36/44
4,451,949 A 6/1984 Long ..... 12/146
4,455,340 A 6/1984 Okina ..... 428/215
4,472,890 A 9/1984 Gilbert ..... 36/28
4,490,928 A 1/1985 Kawashima ..... 36/69
4,494,321 A 1/1985 Lawlor ..... 36/28
4,506,462 A 3/1985 Cavanagh ..... 36/92
4,510,700 A 4/1985 Brown ..... 36/44
4,510,702 A 4/1985 Ehrlich, Jr. ..... 36/86
4,513,518 A 4/1985 Jalbert et al. ..... 36/44
4,515,851 A 5/1985 Johnson ..... 428/246
4,517,981 A 5/1985 Santopietro et al. ..... 128/581
4,527,345 A 7/1985 Lopez Lopez ..... 36/127
4,541,184 A 9/1985 Leighton ..... 36/44
4,541,186 A 9/1985 Mulvihill ..... 36/114
4,557,060 A 12/1985 Kawashima ..... 36/44

(56) References Cited

U.S. PATENT DOCUMENTS 4,564,966 A 1/1986 Chen ..... 12/146
4,581,187 A 4/1986 Sullivan et al. ..... 264/46.4
4,586,273 A 5/1986 Chapnik ..... 36/44
4,597,195 A 7/1986 Dananberg ..... 36/28
4,608,988 A 9/1986 Dananberg ..... 128/581
4,627,177 A 12/1986 Meyers ..... 36/43
4,627,178 A 12/1986 Sullivan et al. ..... 36/44
4,631,841 A 12/1986 Hickey ..... 36/91
D288,621 S 3/1987 Surpuriya et al. ..... D2/961
4,670,996 A 6/1987 Dill ..... 36/42
4,674,204 A 6/1987 Sullivan et al. ..... 36/44
4,677,766 A 7/1987 Gudas ..... 36/43
4,682,425 A 7/1987 Simmons ..... 36/44
4,686,993 A 8/1987 Grumbine ..... 128/581
4,689,898 A 9/1987 Fahey ..... 36/43
4,769,926 A 9/1988 Meyers ..... 36/43
4,777,739 A 10/1988 Hiles ..... 36/43
4,782,605 A 11/1988 Chapnick ..... 36/44
4,798,010 A 1/1989 Sugiyama ..... 36/30
4,803,989 A * 2/1989 Collins ..... A43B 7/1445 36/154
4,813,157 A 3/1989 Boisvert ..... A43B 7/142
4,835,884 A 6/1989 Bianchini et al. ..... 36/24.5
D302,764 S 8/1989 Peoples et al. ..... D2/318
4,852,275 A 8/1989 Bianchini et al. ..... 36/102
4,854,057 A 8/1989 Misevich et al. ..... 36/114
4,866,860 A 9/1989 Blissett et al. ..... 36/28
4,876,805 A 10/1989 Peoples ..... 36/43
4,910,866 A 3/1990 Sullivan et al. ..... 36/44
4,932,141 A 6/1990 Hones ..... 36/43
4,936,030 A 6/1990 Rennex ..... A43B 13/18
4,955,148 A 9/1990 Padilla ..... 36/44
4,972,612 A 11/1990 Prukop et al. ..... 36/145
5,014,706 A 5/1991 Philipp ..... 128/581
RE33,648 E 7/1991 Brown ..... 36/44
5,063,692 A 11/1991 Suginaka ..... 36/43
5,067,255 A * 11/1991 Hutcheson ..... A43B 17/03 36/43
5,129,395 A * 7/1992 Hoffmann ..... A43B 7/142 36/145
D329,129 S 9/1992 Brown ..... D2/961
5,146,697 A 9/1992 Weiss ..... 36/12
5,174,052 A 12/1992 Schoenhaus et al. ..... 36/144
5,184,409 A 2/1993 Brown ..... A43B 7/142
5,311,680 A 5/1994 Comparetto ..... 36/154
D353,710 S 12/1994 Brazzell ..... D2/961
5,373,650 A 12/1994 Dananberg et al. ..... 36/92
D362,956 S 10/1995 Martin et al. ..... D2/961
5,509,218 A 4/1996 Arcan et al. ..... 36/43
5,551,173 A 9/1996 Chambers ..... 36/141
5,584,130 A 12/1996 Perron ..... 36/44
5,625,965 A 5/1997 Blissett et al. ..... 36/43
5,632,104 A 5/1997 Zohar ..... 36/88
5,685,094 A 11/1997 Lin ..... 36/141
5,722,186 A 3/1998 Brown ..... A43B 1/0054
5,782,015 A 7/1998 Dananberg ..... 36/34
5,787,608 A * 8/1998 Greenawalt ..... A61F 5/14 36/169
5,787,610 A 8/1998 Brooks ..... 36/28
6,000,147 A 12/1999 Kellerman ..... 36/160
6,041,524 A 3/2000 Brooks ..... 36/93
6,131,311 A 10/2000 Brown et al. ..... 36/43
6,253,469 B1 7/2001 Atlani et al. ..... 36/174
6,282,816 B1 9/2001 Rosendahl ..... 36/44
6,301,805 B1 * 10/2001 Howlett ..... A43B 7/142 36/43
6,412,198 B1 7/2002 Rothbart ..... 36/144
6,481,120 B1 * 11/2002 Xia ..... A43B 17/003 36/44
6,510,626 B1 1/2003 Greenawalt ..... 36/43
6,604,301 B1 8/2003 Manoli, II et al. ..... 36/43
6,889,452 B2 5/2005 Ailey et al. ..... 36/44
D513,358 S 1/2006 Amado et al. ..... D2/961
7,013,583 B2 3/2006 Greene et al. ..... 36/28
7,062,866 B2 6/2006 Bussier ..... A43B 7/142
7,124,520 B2 10/2006 Galbraith et al. ..... 36/43
7,200,955 B2 4/2007 Foxen ..... 36/25 R
7,264,604 B1 9/2007 Schuren et al. ..... 602/8
7,266,913 B2 9/2007 Axt et al. ..... 36/174
7,322,132 B2 1/2008 Dananberg ..... 36/174
7,380,352 B2 6/2008 Seiter ..... 36/44
7,484,319 B2 2/2009 Cheskin et al. ..... 36/44
7,526,882 B2 5/2009 Rhenter ..... 36/174
7,594,346 B2 9/2009 Dananberg ..... 36/174
7,814,688 B2 10/2010 Dananberg ..... 36/174
7,962,986 B2 6/2011 Dananberg ..... 12/142 N
8,166,674 B2 5/2012 Dananberg ..... 36/43
9,055,781 B2 6/2015 Tzeng
9,460,557 B1 10/2016 Tran et al.
10,702,008 B2 7/2020 Hughes et al. ..... A43B 7/141
2003/0024134 A1 * 2/2003 Howlett ..... A43B 13/181 36/43
2004/0103558 A1 * 6/2004 Everz ..... A43B 17/00 36/43
2004/0118017 A1 * 6/2004 Dalton ..... A43B 17/08 36/3 R
2005/0060909 A1 3/2005 Kerns et al. ..... 36/28
2006/0123663 A1 * 6/2006 Swensen ..... A43B 7/1464 36/43
2007/0033834 A1 2/2007 Cheskin ..... A43B 7/141
2008/0086909 A1 4/2008 Raspini ..... 36/44
2009/0049712 A1 2/2009 Steszyn et al. ..... 36/91
2009/0307925 A1 12/2009 Pfister ..... 36/28
2010/0146816 A1 6/2010 Cappaert ..... 36/91
2010/0287795 A1 11/2010 Van Niekerk ..... A43B 13/14
2011/0035960 A1 2/2011 Werremeyer ..... A43B 7/142
2011/0185590 A1 8/2011 Nishiwaki ..... A43B 5/06
2011/0232129 A1 * 9/2011 Roberts ..... A43B 7/1445 36/43
2012/0174436 A1 7/2012 Hanak ..... 36/43
2012/0255199 A1 10/2012 Tzeng ..... 36/43
2013/0104423 A1 5/2013 Hatfield ..... A43B 5/001
2013/0205620 A1 8/2013 Hsu ..... A43B 7/14
2013/0232816 A1 * 9/2013 Eadie ..... A43B 7/149 36/71
2013/0247418 A1 9/2013 Nurse ..... A43B 3/0031
2013/0283646 A1 10/2013 Seiner ..... A43B 7/00
2016/0015120 A1 1/2016 Denison ..... A43B 3/0094
2017/0007160 A1 1/2017 Latterman ..... A61N 5/107
2017/0027277 A1 2/2017 Anthony et al. ..... A43B 7/14
2017/0251749 A1 9/2017 Hughes et al. ..... A43B 7/141
2018/0092429 A1 4/2018 Hughes et al. ..... A43B 7/141
2018/0200099 A1 * 7/2018 Hanft ..... A43B 7/144
2021/0298412 A1 * 9/2021 Takahashi ..... A43B 17/02

FOREIGN PATENT DOCUMENTS

CN 2688103 3/2005 ..... A43B 17/08
CN 2770419 4/2006 ..... A43B 13/14
CO 6930029 4/2014 ..... A43B 3/24
DE 22803 6/1883 ..... B41B 3/04
DE 660551 3/1938 ..... A43B 13/00
DE 875466 7/1949 ..... A43B 7/22
DE 397602 5/1994 ..... C07C 273/06
EP 427556 5/1991 ..... A43B 7/08
EP 591909 10/1993 ..... A43B 7/00
FR 1163646 9/1958 ..... A43B 13/14
FR 1207258 2/1960 ..... A43B 13/38
FR 1413280 10/1965 ..... A43B 13/41
FR 2015914 4/1970 ..... A43B 13/00
FR 2272618 3/1975 ..... A43B 7/00
FR 2309169 5/1975 ..... A43B 7/28
FR 2427801 6/1978 ..... A43B 21/32
FR 2506132 5/1981 ..... A41D 27/12
FR 2522482 1/1982 ..... A43B 17/14
GB 217833 6/1924 ..... A43B 17/00
GB 452492 11/1934 ..... A43B 13/38
GB 644712 10/1950
GB 1243575 8/1971 ..... A43B 17/14
GB 1564195 4/1980 ..... C08G 18/06
GB 2057964 4/1981 ..... B29D 9/06
GB 2088776 6/1982 ..... B32B 5/18

(56) References Cited

FOREIGN PATENT DOCUMENTS

| | | | |
|---|---|---|---|
| GB | 2501893 | 11/2013 | A43B 13/38 |
| HU | 209953 | 2/1995 | A43B 13/40 |
| JP | 10-234417 | 8/1998 | A43B 17/00 |
| JP | 2001-523981 | 11/2001 | A43B 13/12 |
| WO | WO9107152 | 5/1991 | A61F 5/14 |
| WO | WO9200714 | 1/1992 | A61H 7/00 |
| WO | WO9814083 | 4/1998 | A43B 7/16 |
| WO | WO9818358 | 5/1998 | A43B 7/22 |
| WO | WO2004012548 | 2/2004 | A43B 7/22 |
| WO | WO2004093584 | 4/2004 | A43B 7/38 |
| WO | WO2006043923 | 4/2006 | A43B 19/00 |
| WO | WO2010085485 | 7/2010 | A43B 13/14 |
| WO | WO2011017174 | 2/2011 | A43B 13/38 |
| WO | WO2015112471 | 7/2015 | A43B 13/40 |
| WO | WO2016178638 | 11/2015 | A43B 13/18 |
| WO | WO2016185400 | 11/2016 | G06Q 30/02 |

OTHER PUBLICATIONS

U.S. Appl. No. 15/356,256, filed Nov. 18, 2016.
U.S. Appl. No. 15/819,951, filed Nov. 21, 2017.
U.S. Appl. No. 16/686,963, filed Nov. 18, 2019.
"A Manual of Lower Extremities Orthotics", ed. Miles H. Anderson, pp. 109-111, 1972.
"Anthropometry of the Foot and Lower Leg of U.S. Army Soldiers: Fort Jackson, SC—1985" NATICK/TR-92/028. Natick, Ma: U.S. Army Natick Research, Development, and Engineering Center (ADA261405), 1992 (360 pgs).
"Common Foot Disorders: Diagnosis and Management", ed. Donald Neale, pp. 44-47, 52-54, 65-66, 192-194, 1981.
"Lower Limb Orthotics: 1981 Revision", Prosthetics and Orthotics Department, New York University, Post-Graduate Medical School, pp. 172-179, copyright 1981.
"Mechanical Foot Therapy", Philip R. Brachman (the Leicht Press) pp. 292-295, 1946.
"New Styling for High-Heeled Comfort: the Classic Pump Redefined for Fashion Wear" Dananberg, Current Podiatric Medicine, 1990, pp. 29-32.
"Podopediatrics—the Care of Childrens Feet" by Herman R. Tax, B.S., Pod.D., Copyright 1947 ("Manual"), pp. Forward and 101-105 and 108-110.
"Shear Madness" Footwear News, vol. 53, No. 15 (2 pgs).
Herman R. Tax, D.P.M., "Podopediatrics", 1980, pp. 189, 221-242.
Merton L. Root, D.P.M.; William P. Orien, D.P.M.; and John H. Weed, D.P.M.; normal and abnormal Function of the Foot, 1977, Clinical Biomechanics, vol. II, pp. 355-367.
Plastic Insole from Standing Ovation TM Shoes by HBN Shoe, LLC,1997; U.S. Appl. No. 29/196,783.

* cited by examiner

FIG. 4 – PRIOR ART

BOF LENGTH, RIGHT

MALE DATA

* * * * *

PERCENTILES

| CENTIMETERS | | INCHES |
|---|---|---|
| 17.38 | 1ST | 6.84 |
| 17.58 | 2ND | 6.92 |
| 17.72 | 3RD | 6.98 |
| 17.93 | 5TH | 7.06 |
| 18.28 | 10TH | 7.19 |
| 18.52 | 15TH | 7.29 |
| 18.73 | 20TH | 7.37 |
| 18.91 | 25TH | 7.44 |
| 19.07 | 30TH | 7.51 |
| 19.22 | 35TH | 7.57 |
| 19.37 | 40TH | 7.62 |
| 19.51 | 45TH | 7.68 |
| 19.65 | 50TH | 7.74 |
| 19.79 | 55TH | 7.79 |
| 19.93 | 60TH | 7.85 |
| 20.08 | 65TH | 7.91 |
| 20.24 | 70TH | 7.97 |
| 20.40 | 75TH | 8.03 |
| 20.59 | 80TH | 8.11 |
| 20.81 | 85TH | 8.19 |
| 21.09 | 90TH | 8.31 |
| 21.51 | 95TH | 8.47 |
| 21.79 | 97TH | 8.58 |
| 22.00 | 98TH | 8.66 |
| 22.34 | 99TH | 8.79 |

* * * * *

THE SUMMARY STATISTICS

| CENTIMETERS | | INCHES |
|---|---|---|
| 19.67 | MEAN | 7.74 |
| .06 | SE(M) | .02 |
| 1.07 | ST DEV | .42 |
| .04 | SE(SD) | .02 |

* * * * *

| | |
|---|---|
| COEFF. OF VARIATION | 5.5% |
| SYMMETRY------VETA I | .16 |
| KURTOSIS------VETA II | -.27 |

* * * * *

| | |
|---|---|
| NUMBER OF SUBJECTS | 291 |

FEMALE DATA

* * * * *

PERCENTILES

| CENTIMETERS | | INCHES |
|---|---|---|
| 15.31 | 1ST | 6.03 |
| 15.61 | 2ND | 6.14 |
| 15.79 | 3RD | 6.22 |
| 16.03 | 5TH | 6.31 |
| 16.40 | 10TH | 6.46 |
| 16.65 | 15TH | 6.55 |
| 16.85 | 20TH | 6.63 |
| 17.02 | 25TH | 6.70 |
| 17.18 | 30TH | 6.76 |
| 17.32 | 35TH | 6.82 |
| 17.46 | 40TH | 6.88 |
| 17.60 | 45TH | 6.93 |
| 17.74 | 50TH | 6.98 |
| 17.88 | 55TH | 7.04 |
| 18.02 | 60TH | 7.09 |
| 18.16 | 65TH | 7.15 |
| 18.32 | 70TH | 7.21 |
| 18.49 | 75TH | 7.28 |
| 18.68 | 80TH | 7.35 |
| 18.90 | 85TH | 7.44 |
| 19.17 | 90TH | 7.55 |
| 19.57 | 95TH | 7.70 |
| 19.81 | 97TH | 7.80 |
| 19.98 | 98TH | 7.86 |
| 20.22 | 99TH | 7.96 |

* * * * *

THE SUMMARY STATISTICS

| CENTIMETERS | | INCHES |
|---|---|---|
| 17.75 | MEAN | 6.99 |
| .05 | SE(M) | .02 |
| 1.10 | ST DEV | .43 |
| .04 | SE(SD) | .01 |

* * * * *

| | |
|---|---|
| COEFF. OF VARIATION | 6.2% |
| SYMMETRY------VETA I | -.26 |
| KURTOSIS------VETA II | 1.13 |

* * * * *

| | |
|---|---|
| NUMBER OF SUBJECTS | 490 |

With trim to fit insole in accordance with the present invention observations:
Excellent Symmetry
Excellent Curve Shape
Forefoot peak higher than heel peak With conventional insole observations:
Poor curve shape
No Symmetry
Flat red curve (L) with heel peak higher than forefoot With trim to fit insoles in accordance with the present invention Observations:
Straight foot position
Limited great toe pressure
Toe grip ground normally With conventional insole Observations:
Feet rolled outward
High great toe pressure
Toes fail to grip normally With conventional insole Observations:
Marked increase in great toe pressure
Increased 1st metatarsal head pressure With trim to fit insole in accordance with present invention Observations:
Marked decrease in pressure under great toe
Decrease medial 1st metatarsal head pressure With trim to fit insoles in accordance with the present invention Observations With trim to fit insole in accordance with the present invention
Observations:
Shorter heel contact duration
Shorter step duration
Improved shape of peak in heel curve R with conventional insole
Observations:
Longer heel contact duration
Slightly longer step duration
Slightly flattened peak heel curve With trim to fit insole in accordance with the present invention Less Great Toe Pressure More Great Toe Pressure Change is Load Placement With conventional insoles

FOOTWEAR INSOLE

CROSS REFERENCE TO RELATED APPLICATION

Not applicable

STATEMENT REGARDING FEDERALLY SPONSORED RESEARCH OR DEVELOPMENT

Not applicable

BACKGROUND OF THE INVENTION

The present invention relates to footwear, and more particularly to insoles having features that improve the function of the first metatarsal which leads to an improvement in gait and that results in increased comfort and increased efficiency.

In order to understand the prior art and the present invention, it is necessary to understand the anatomy of the foot and the basics of shoe construction. FIG. 1A is a diagrammatic medial side view of the bones of the human foot 10, and FIG. 1B is a top plan view of the bones of the human foot. For purposes of this application, references to heelward or rearward mean in the direction of the rear of the foot or heel 20; references to forward or toeward mean in the direction of the front of the foot 30 where the toes or phalanges 31 are located; references to medial mean the side of the foot where the arch 40 is located; references to lateral mean the outside of the foot; and references to upper or top and lower, bottom or under assume the foot or shoe is oriented in an upright position.

Referring to FIG. 1A, the calcaneus (22) is an irregularly shaped quadrangular bone also called the heel bone or os calcis. The medial side of the calcaneal tuberosity, i.e. the lower part of the posterior surface of the calcaneus is not precisely on the same ground or plane as the lateral tuberosity. This slight difference in calcaneal anatomy leads to potential for instability on level surfaces, such as sidewalks, gym floors, hardwood, etc.

Referring also to FIG. 1B, the bones of the foot also include the navicular 41, the three cuneiform 42, the metatarsals 45A-45E and the phalanges, or toes 31A-31E, with the big toe 31A visible in FIG. 1. The metatarsal heads 46A-46F are located at the forward end of the metatarsal shafts 47A-47E. Although it's one of the smaller parts of the body, all told the foot contains 26 bones, 33 joints and more than 100 muscles. Together, a person's two feet contain more than a quarter of all the bones in the human body which interact and undergo significant stresses during standing, walking and running.

Human footwear is designed to protect the human foot. However, as currently designed, human footwear is imperfect in providing proper biomechanical support for the human foot.

Also depicted in FIG. 1A is a partial cross-sectional view of the portions of a conventional shoe 50 that underlie the sole of the foot, the top parts of the shoe being shown in phantom. Shoe 50 has a heel 51 which is attached to the lower surface of sole 52 of shoe 50, with the sole 52 in turn supporting an insole board 53 on which a sock liner 54 is placed. In a conventional shoe, the insole board typically is of relatively rigid construction from the region underlying the wearer's heel to the heads of the metatarsals. Sock liners are commonly very flexible and generally are very thin, typically no more than half a millimeter thick. The sock liner is the surface upon which the sole of the foot normally rests.

In prior U.S. Pat. No. 4,597,195 to Dananberg (the '195 patent), there is described a human shoe sole having an area of relief underlying substantially only the location of the first metatarsal head of the wearer's foot. As described in the '195 patent, providing an area of reduced support substantially only under the head of the first metatarsal encourages eversion and plantar flexion of the first metatarsal head as weight shifts from the heel to the first ray. Thus, normal functioning of the foot for plantar flexion and supination is encouraged with beneficial results for improved walking comfort and enhanced "windlass effect". Prior PCT application WO 2011/017174 A1 describes an improvement in a human shoe sole or insole in which a depression provided underlying the first metatarsal head in which the depression has its lowest point skewed to the medial side of center.

The foregoing discussion of the prior art derives primarily from prior U.S. Pat. No. 10,702,008 to Hughes and Dananberg (the '008 patent), in which there is described a shoe or insole device for insertion into a shoe having a foot supporting upper surface, wherein the shoe or device has an upward facing shallow channel on the foot supporting upper surface adapted to underlie the first metatarsal shaft and heelward of the first metatarsal head of the wearer. The channel is adapted to specifically extend in a direction from the toe end of the shoe heelward only under the first metatarsal shaft to short of the first metatarsal head of the wearer, and is pitched or rotated 4±1 degrees plantargrade, with a toeward end of the channel lower than the heelward end of the channel. The channel is rolled or sloped in a lateral to medial direction downward 9±2 degrees, in the frontal plane and the channel is yawed or rotated 10±5 degrees clockwise relative to a superior view of the transverse plane, for the left foot shoe, and yawed or rotated 10±5 degrees counterclockwise relative to a superior view of the transverse plane for the right foot shoe. The shoe or insole device is contoured and has a dome or raised area supporting surface having its highest point configured to underlie between the first and second metatarsal shafts rearward of the first and second metatarsal heads of the wearer.

Millions of pairs of shoes and insoles including custom orthotics have been manufactured and sold incorporating relief under the first metatarsal head as described above. As will be appreciated, providing relief under the first metatarsal head requires proper placement of the reduced support relief. An earlier study "Anthropometry of the Foot and Lower Leg of US Army Soldiers: Fort Jackson, S.C.—1985" by Parham et al., September 1992 reports a ball of foot (BOF) length standard deviation of 0.42 inches in the case of men enrolled in the study, and a BOF length standard deviation of 0.43 inches for women enrolled in the study (see FIG. 4). Also, BOF length of an individual's left and right feet vary. While custom orthotics can be made to essentially exactly fit individual feet, mass produced shoes and insoles are at best compromise when it comes to locating relief under the first metatarsal head. The problem of properly locating relief under the first metatarsal head is further exacerbated in the case of mass produced one size fits all trim to fit after-market insoles.

BRIEF SUMMARY OF THE INVENTION

The present invention provides improvements over current footwear products in terms of function, comfort, manufacturing and sizing. In one aspect, the present invention provides significant improvement in terms of biomechanical functioning of footwear products, in particular trim to fit insoles, molded sandals and flip-flops, by providing such footwear products with an upper surface having a raised metatarsal pad having a first region rising at a slope inboard from the medial edge and configured to underlie the first metatarsal head of the wearer, a second region configured to underlie the second to fifth metatarsal shafts of the wearer, and a third region sloping downward towards the lateral edge of the insoles, wherein the first region is configured to evert the first metatarsal of the wearer. The footwear product may be in the form of an insole including in particular a trim to fit insole, or a molded sandal or a flip flop. The first region of the raised metatarsal pad is on the medial side and has a slope of about 5 to 9°, preferably about 6 to 8°, more preferably about 7°. The third region of the raised metatarsal pad is on the lateral side and has a slope of about 4° to 6°, preferably about 4.5° to 5.5°, more preferably about 5°. The top edge of the third region is lower than the top edge of the first region. The second region of the raised metatarsal pad has a toeward surface, a top surface and a heelward surface that smoothly bridge across the first and second regions and blend with the top surface of the flat section of the insole the metatarsal pad is added to. This designs results in increased comfort to the wearer as well as simplified manufacturing and sizing by providing a contoured foot supporting surface across a range of several shoe sizes. The raised material pad having a sloped edge in the medial side allows the first metatarsal join to drop and rotate, i.e., evert, which enhances the flexibility of the joint, while the sloped third region on the lateral side allows the fifth metatarsal to invert. By extending the length of the pad and its sloped edge from about 4 cm, to about 8 cm, the insole or foot supporting surface can be configured to accommodate the likely BOF length for two US shoe sizes to a range of BOF lengths which could effectively function over a range of seven US shoe sizes. Note that a 4 cm long pad would need to be correctly positioned for the appropriate BOF length for the respective shoe size. The 8 cm long pad can provide functional support over seven US Shoe sizes, it's positioning will govern which seven sizes it covers.

The invention also optionally may include modifying the heel area or heel cup area of the foot supporting surface to reduce the pressure on the plantar fascia of the wearer as it travels from its attachment on the medial calcaneus to the proximate phalanges, as described in our aforesaid U.S. Pat. No. 10,702,008, the contents of which are incorporated herein by reference. The heel cup includes a hollowed or depressed heel cup region (1-3 mm deep), adapted to underlie the heel of the wearer. The hollowed or depressed heel cup region is asymmetrical with its lowest region located to the medial side of the heel, and has a forward extension on the heel cup medial side.

The raised metatarsal pad can be formed on the foot supporting surface of an after-market trim to fit insole, or formed on the foot supporting surface of a molded sandal or flip-flop. A feature and advantage of the present invention is that the raised metatarsal pad accommodates various individual's metatarsal head BOF lengths over several, e.g., up to seven shoes sizes. Thus, in the case of after-market insoles, which typically are made and sold as trim to fit over several sizes, the number of SKU's required is reduced. By way of example, with this invention three, four, five, six or seven full US shoe sizes, i.e. US Men's size 7 to 13, or alternatively, US Women's size 6 to 12, can be functionally accommodated by a single SKU. That is to say, footwear products incorporating a raised metatarsal pad as described may be formed integrally with the foot bed of a molded sandal or flip flop, or as a trim to fit after-market insole. As used herein, "footwear product" is intended to refer to all such embodiments.

BRIEF DESCRIPTION OF THE DRAWINGS

Further features and advantages of the present invention can be seen, in detailed description, taken in conjunction with the accompanying drawings, wherein:

FIG. 4 is a reproduction of a summary table from the Parham et al. report mentioned earlier.

DETAILED DESCRIPTION OF THE INVENTION

As used herein the term "sole", "insole" are used interchangeably. Moreover, a "sole" or "insole" may be an element built into or forming an integral element of a molded footwear product such as a sandal or flip flop, or as removable insole, including trim to fit after-market insole devices spanning several shoe sizes, which may be inserted into a footwear product post-manufacture.

Figure 1A:
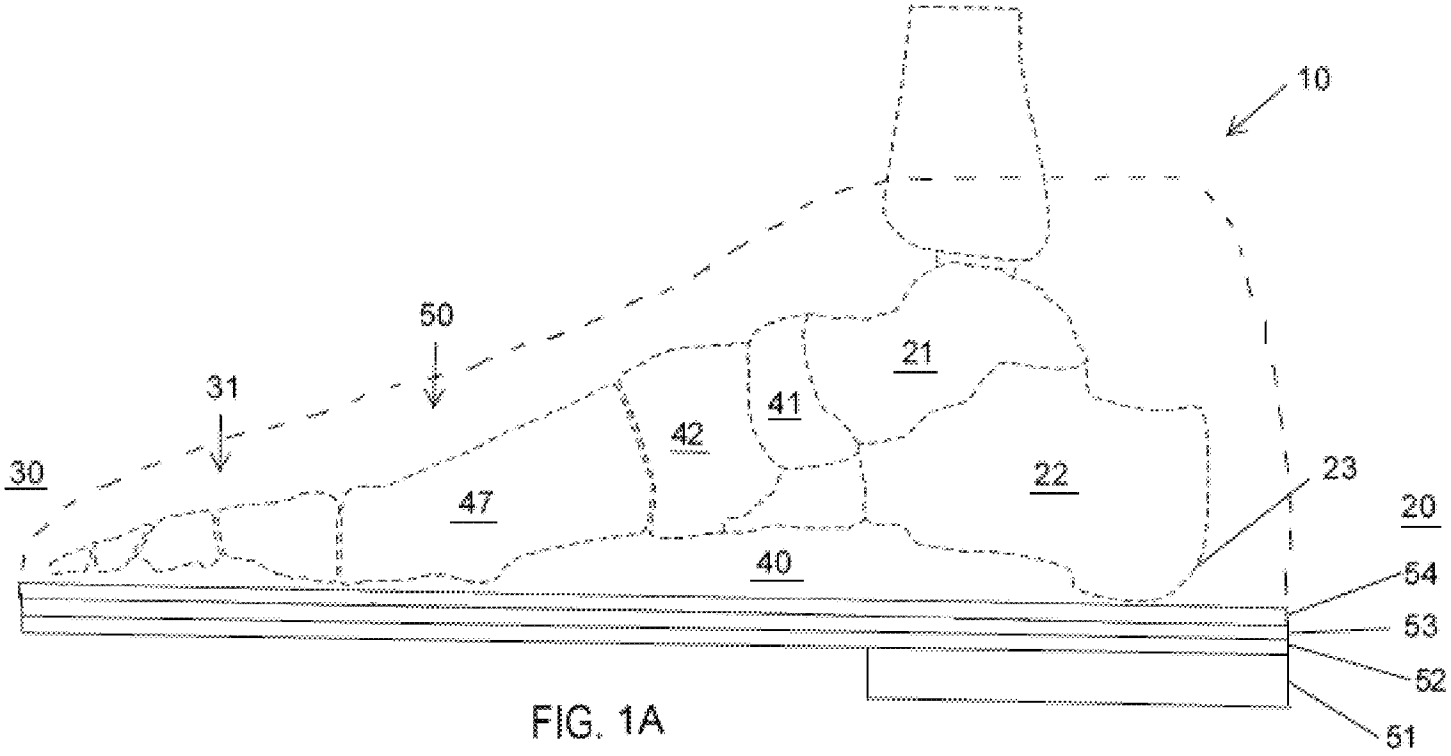
FIG. 1A PRIOR ART
FIG. 1A is a diagrammatic cross-sectional view of the bones of a human foot.
Figure 1B:
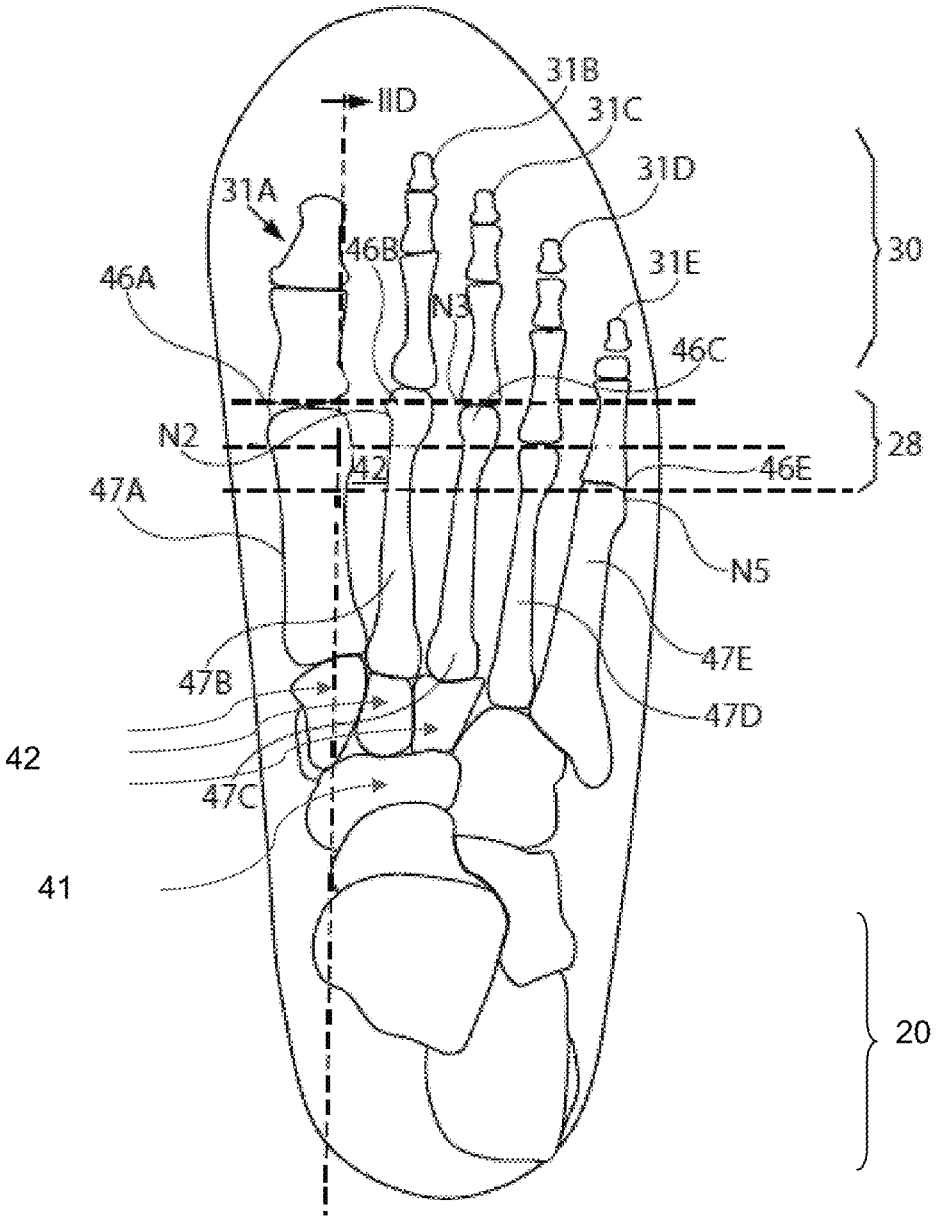
FIG. 1B PRIOR ART
FIG. 1B is a top plan view of the bones of a human foot.
Figure 2:
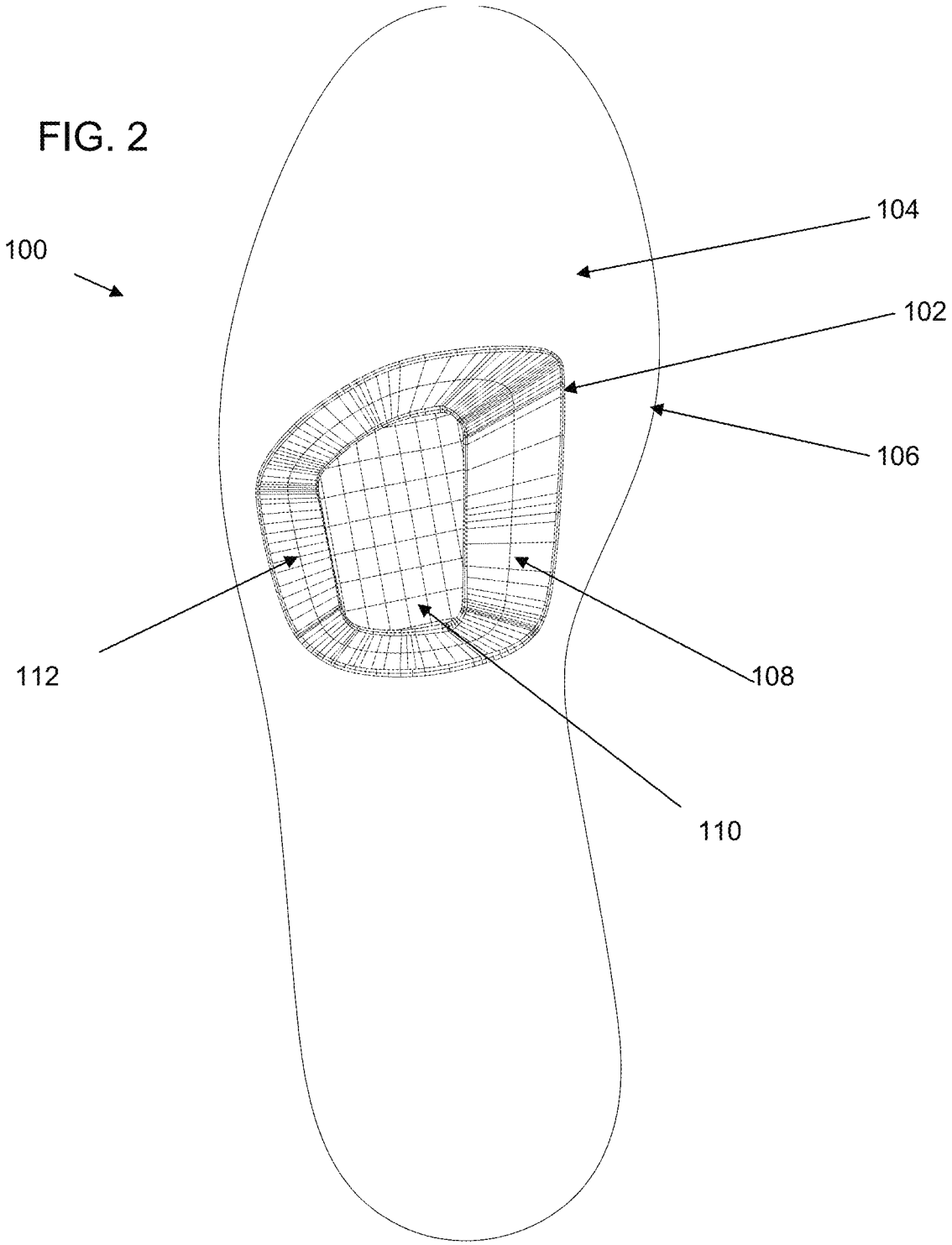
FIG. 2 is a top plan view of a left foot supporting trim to fit insole for a men's shoe in accordance with one embodiment of the present invention, the right foot supporting insole being a mirror image thereof.
Figure 3A:
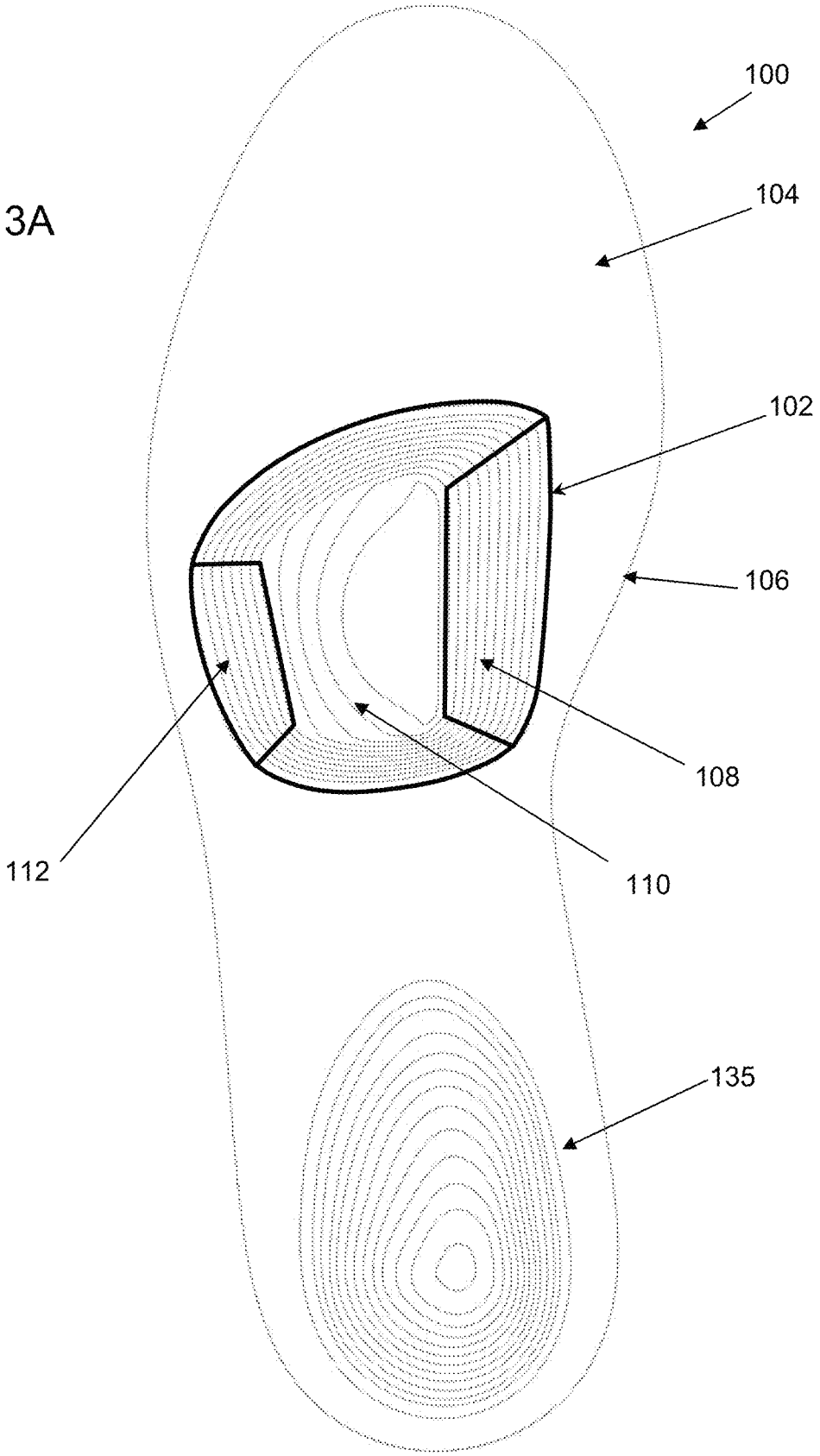
FIG. 3A is a top plan view of a left foot supporting surface of a trim to fit insole in accordance with the present invention, with contour lines take at 0.2 mm superimposed thereon, the right foot supporting surface being a mirror image thereof.

Referring to FIGS. 2 and 3, there is illustrated a trim to fit insole 100 having a metatarsal pad on the foot supporting surface 104 of the insole 100. Metatarsal pad 102 is formed inboard from the medial edge 106 of the insole 100 and has a first sloped region 108, configured to underlie the first metatarsal head of the wearer, a second top surface region 110 configured to underlie the second to fourth metatarsal shafts of the wearer, and a third region 112 configured to underlie the fifth metatarsal head of the wearer sloping downward towards the lateral edge of the insole 100. The first sloped region 108 is configured to evert the first metatarsal of the wearer. The footwear product may be in the form of an insole including in particular a trim to fit insole, or a molded sandal or a flip flop. The raised metatarsal pad first region 108 has a slope of about 5 to 9° on the medial side, preferably about 6 to 8°, more preferably about 7°. The third region 112 of the raised metatarsal pad has a slope of about 4° to 6° on its lateral side, preferably about 4.5° to 5.5°, more preferably about 5° and is configured to invert the fifth metatarsal of the wearer. The top edge of the lateral slope of surface 112 is lower than the top edge of the medial slope of surface 108. The second region 110 of the raised metatarsal pad has toeward and heelward surfaces that smoothly bridge from surface 112 to 108 and to the top surface 104 of the flat section of the insole the metatarsal pad is added to. The top surface of the metatarsal pad 110 smoothly bridges across all of the sloped surfaces of the raised metastarsal pad. The construction of raised metatarsal pad 100 results in increased comfort to the wearer as well as simplified manufacturing and sizing by providing a contoured foot supporting surface across a range of several shoe sizes. The raised material pad 100 having a sloped edge region 108 in the medial side allows the first metatarsal joint to drop and rotate, i.e., evert, which enhances the flexibility of the joint. By extending the length of the pad and its sloped edge from about 4 cm, to about 8 cm, the insole or foot supporting surface can be configured to accommodate a single BOF length or a range of BOF lengths which could effectively function over a range of seven US shoe sizes. Note that a 4 cm long pad would need to be correctly positioned for the appropriate BOF length for the respective shoe size. The 8 cm long pad can provide functional support over seven US Shoe sizes, it's positioning will govern which seven sizes it covers.

Figure 3B:
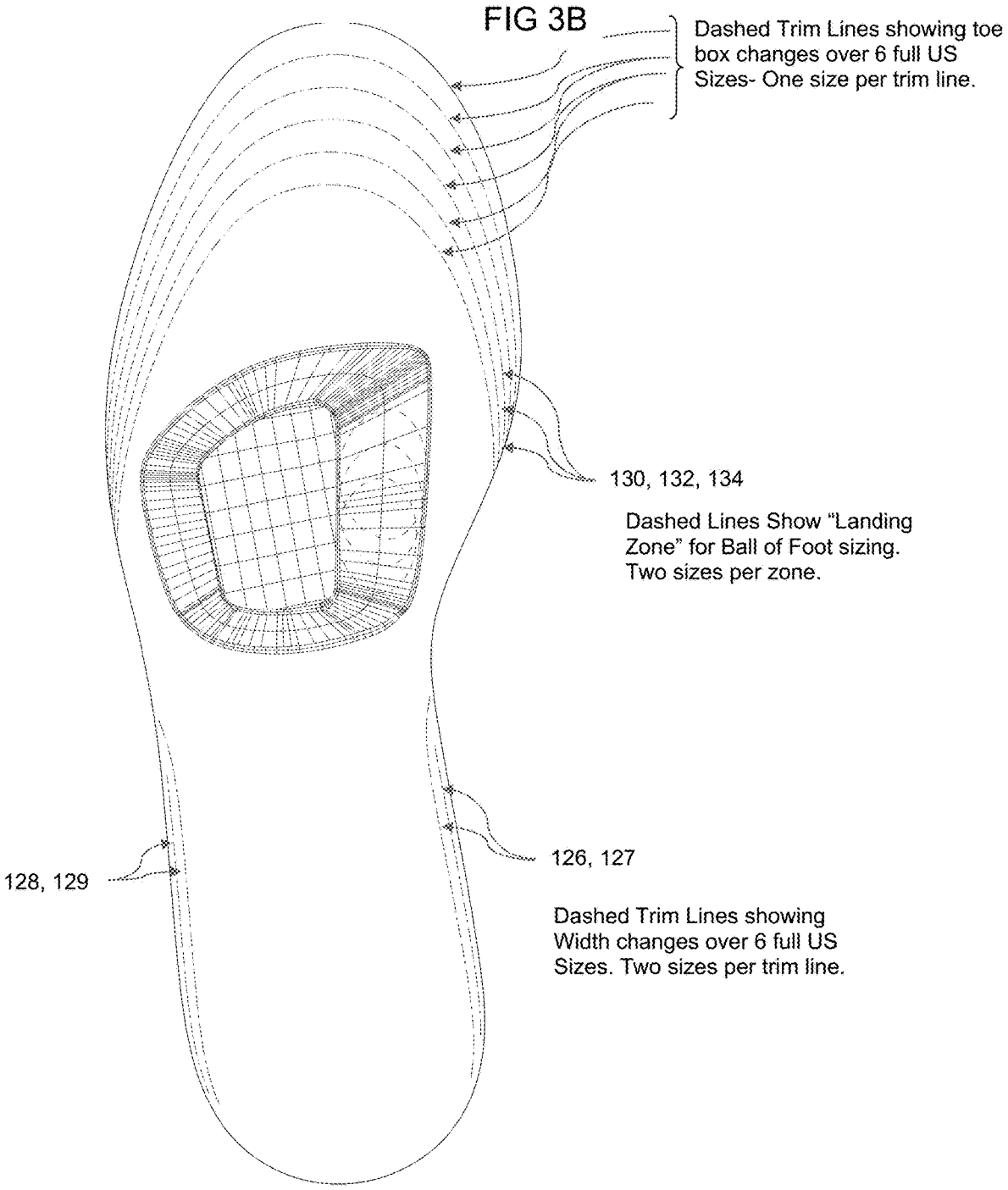
FIG. 3B is a top plan view of a left foot supporting surface of a trim to fit insole in accordance with the present invention, showing Trim Lines for length and width changes over six full US show sizes and "landing zones" for the Ball of Foot over multiple full US shoe sizes, the right foot supporting surface being a mirror image thereof.
Figure 5A:
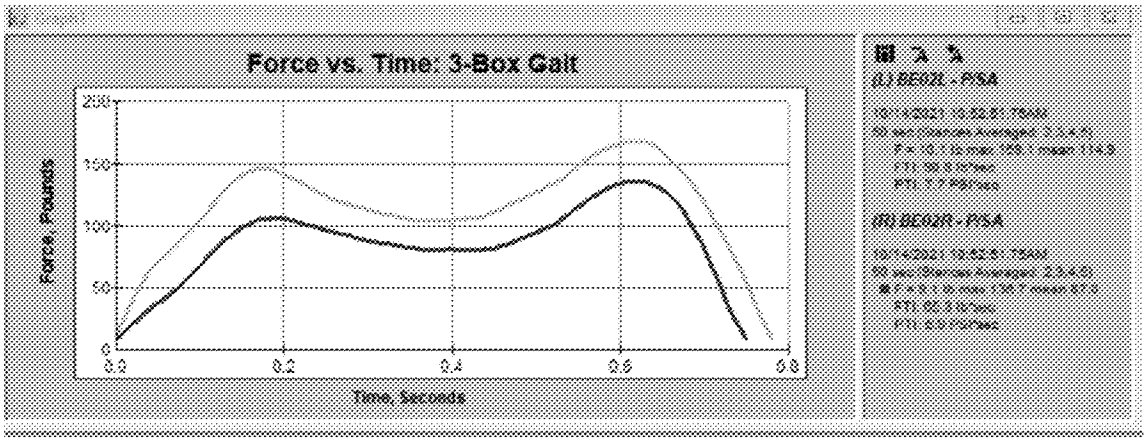
FIGS. 5A-11B are graphs and pressure loads, as the case may be, demonstrating improvements in gait and in pressure loadings of individuals achieved by the present invention.
Figure 5B:
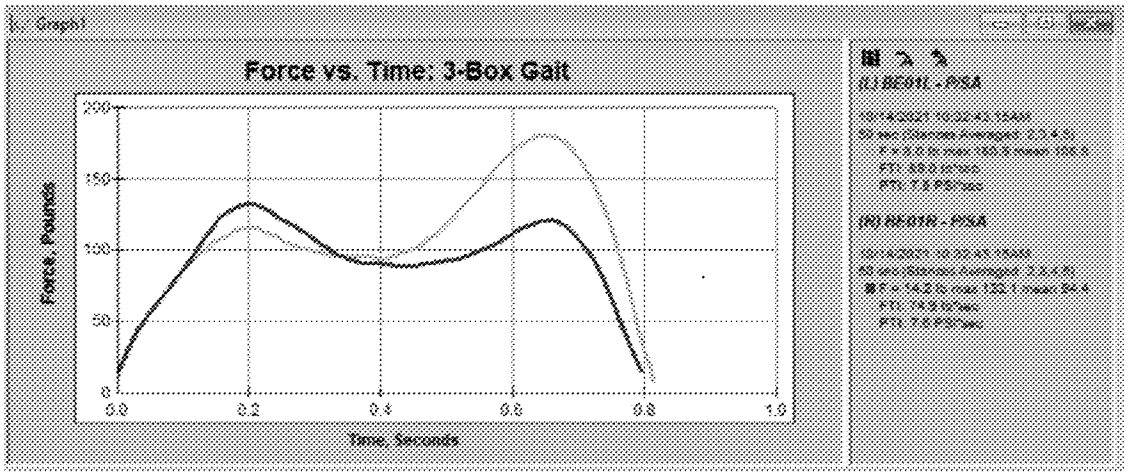
Figure 6A:
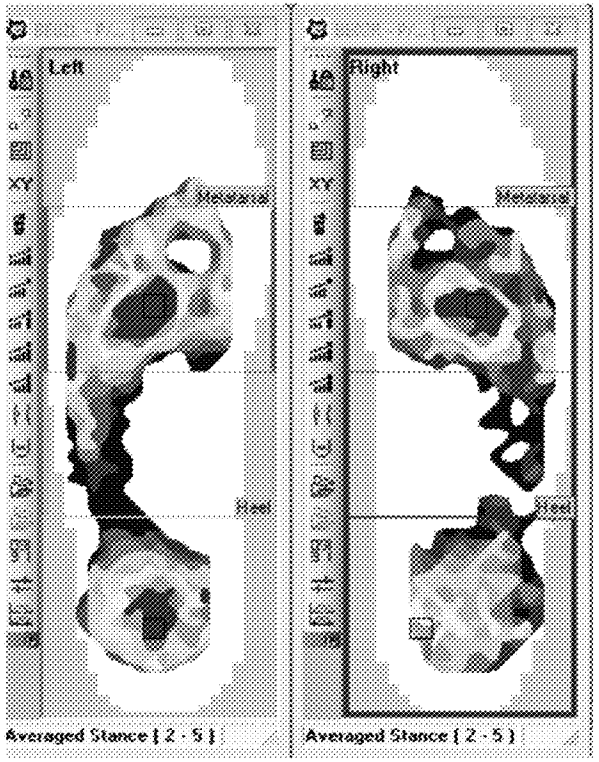
Figure 6B:
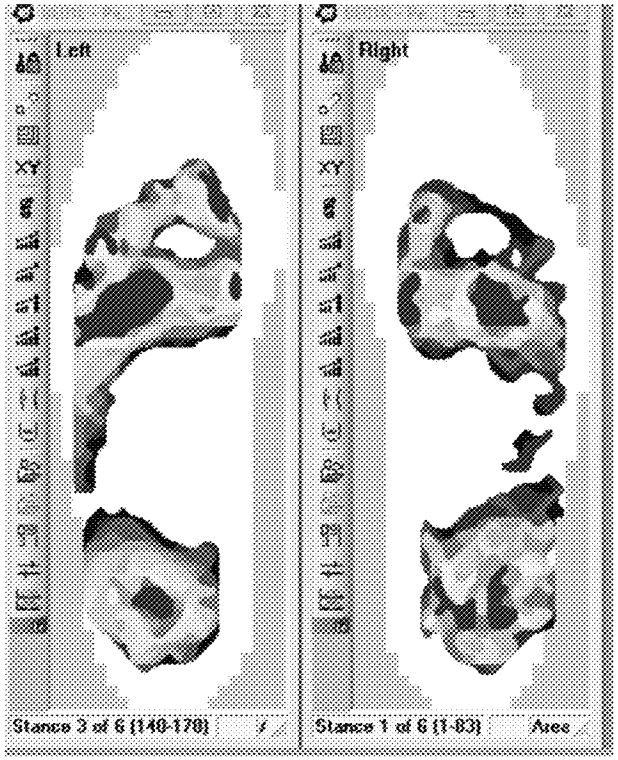
Figure 7B:
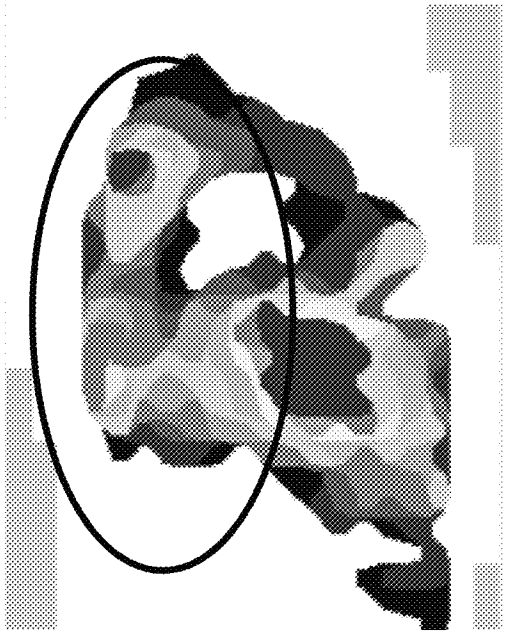
Figure 7A:
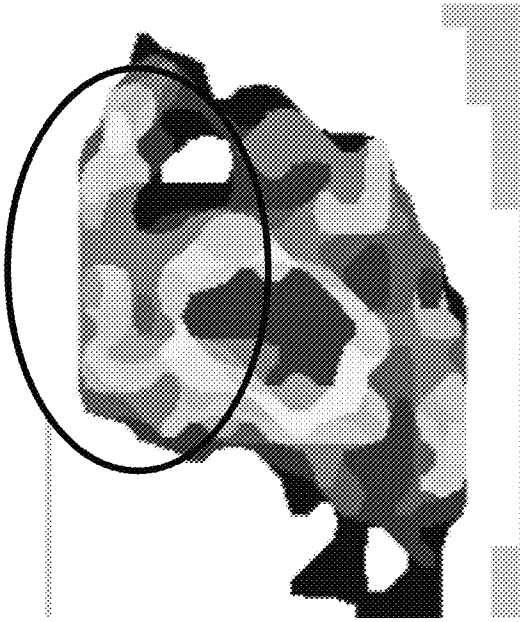
Figure 8A:
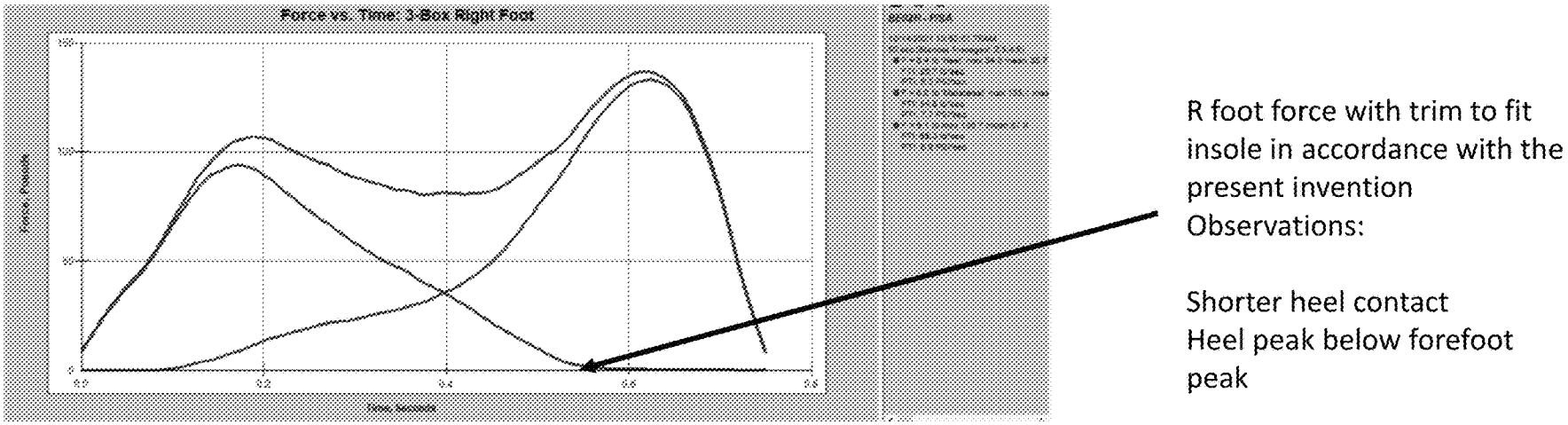
Figure 8B:
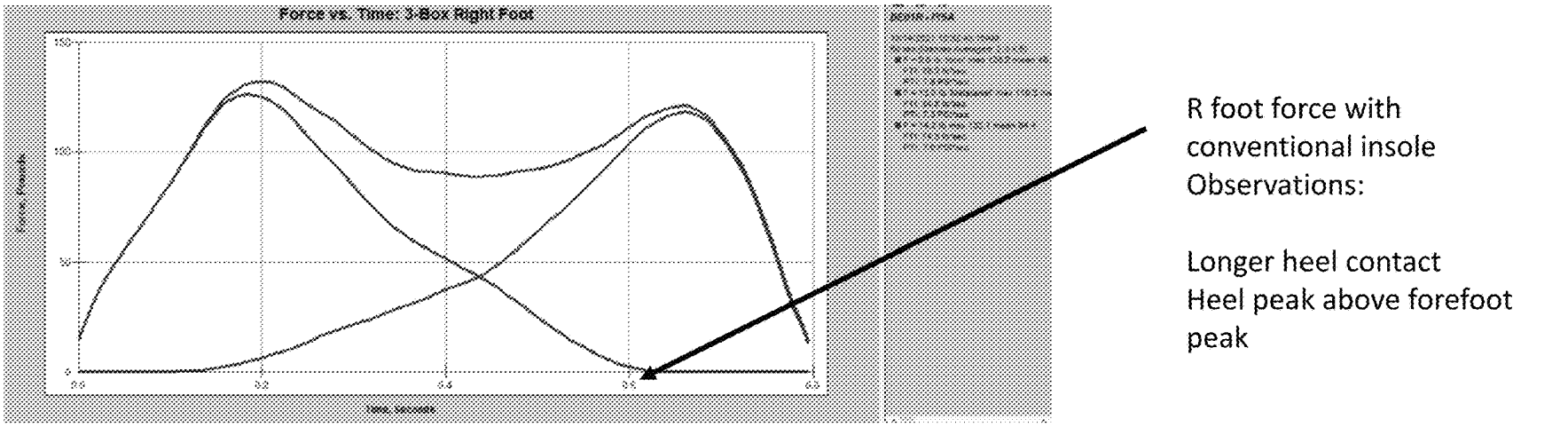
Figure 9A:
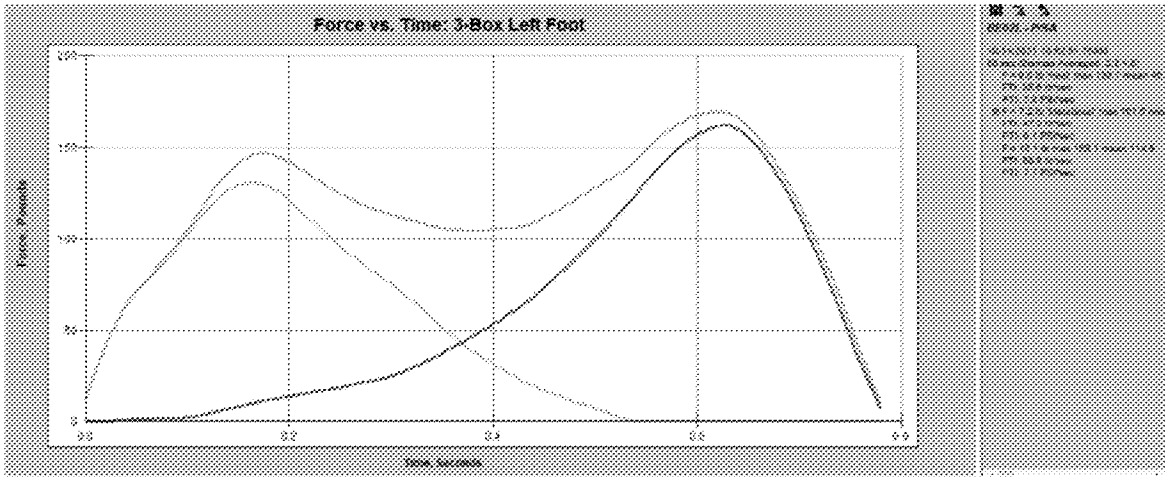
Figure 9B:
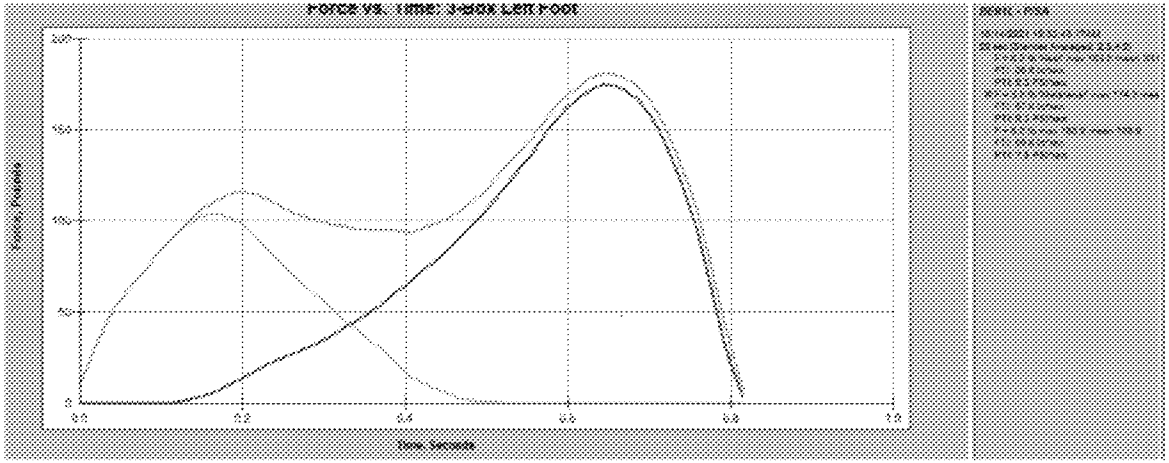
Figure 10A:
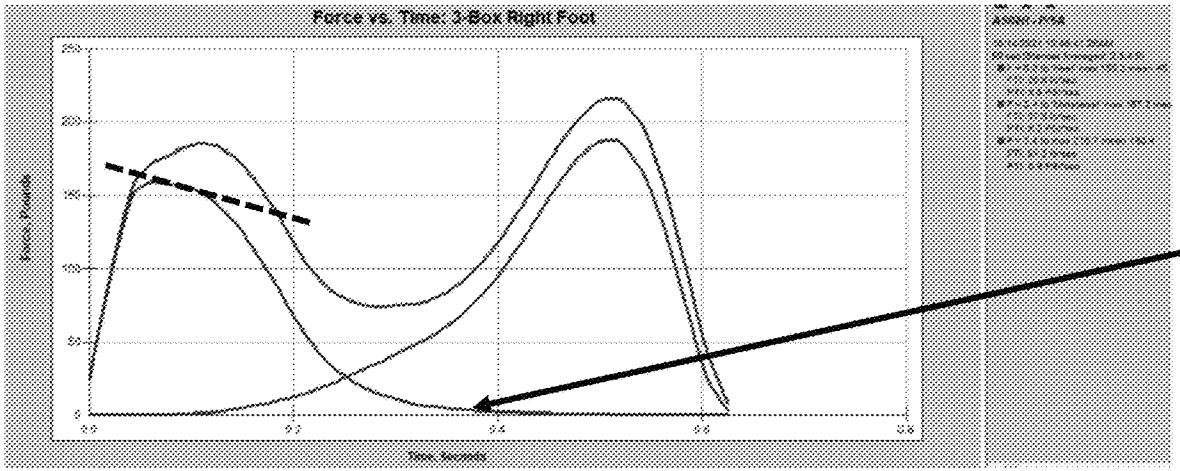
Figure 10B:
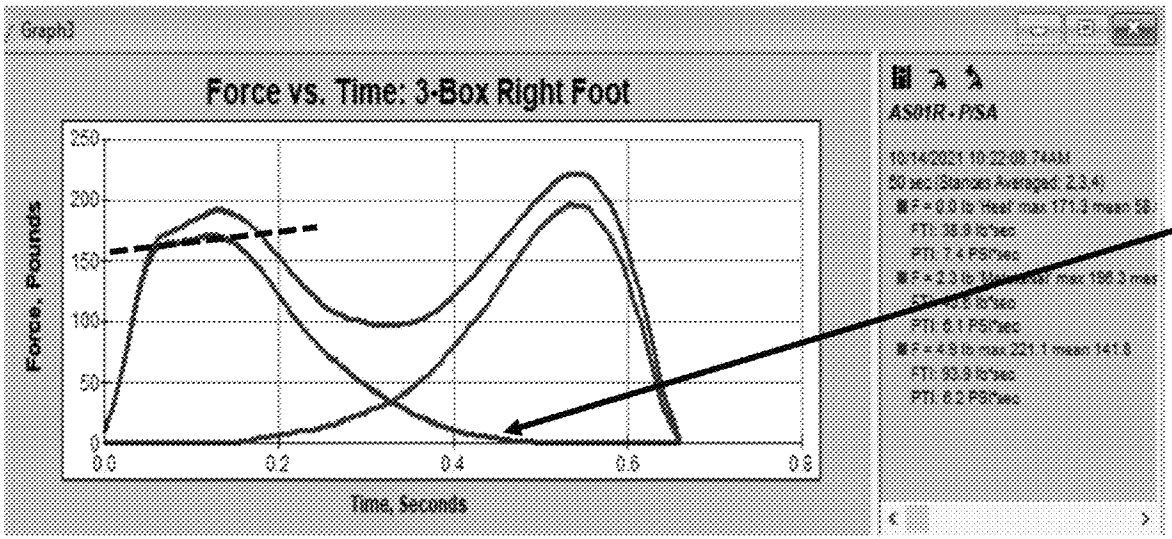
Figure 11A:
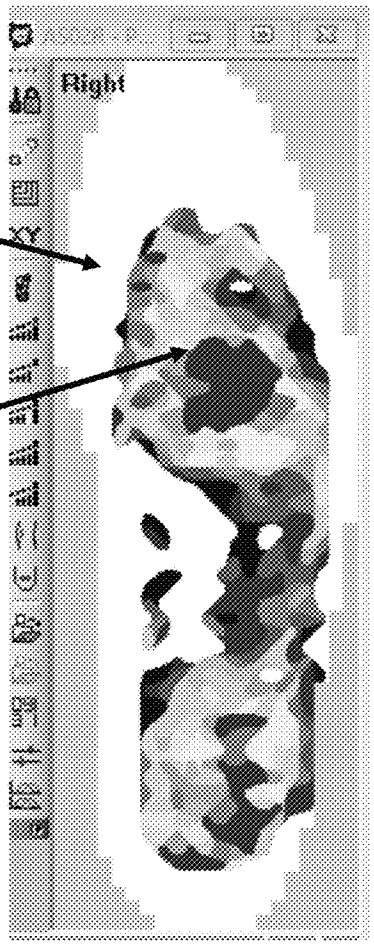
Figure 11B:
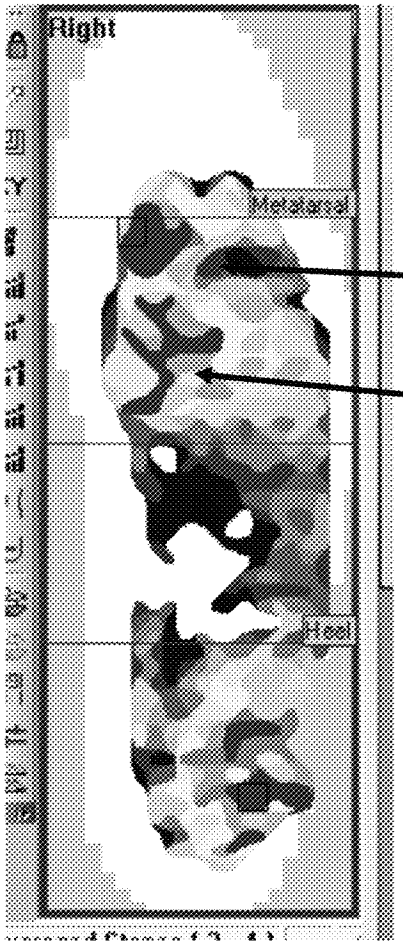

Referring in particular to FIG. 3B, being a trim to fit insole, the insole 100 may include shoe size length trim lines 120 thru 124 and width trim lines 126 thru 129. Also, to facilitate better understanding of the versatility of our invention, FIG. 3B also shows, superimposed over the foot supporting surface, areas marked 130, 132, 134 where a typical wearer's first metatarsal head may fall, depending on the individual's BOF length, and shoe size.

The trim to fit insole also optionally may include a heel cup 135 shown in FIG. 3 in the form of lop-sided generally round shaped depression 136, with its lowest region 137 preferably located slightly to the medial side of the heel. Heel cup 135 is generally round in plan, and includes a forward depressed extension region 138 on its medial side, which serves to reduce pressure on the plantar fascia of the wearer's foot, as it travels from its attachment on the medial calcaneus to the proximal phalanges. Heel cup 135 typically is 1-4 mm deep at its lowest point, preferably 2-3.5 mm deep, more preferably 2.5-3 mm deep. The region immediately forward heel cup 135 is raised relative to depression 136. Preferably the region 137 of heel cup 135 is elongated and rotated 3±2 degrees clockwise on the left shoe or insole, and 3±2 degrees counterclockwise on the right shoe or insole.

FIGS. 5A-9B are graphs and pressure loads demonstrating improvements in gait and in pressure loadings of a first individual wearing shoes with conventional insoles, and trim to fit insoles made in accordance with the present invention.

As can be seen:

Graph shapes show marked improvement with versus without the trim to fit insole of the present invention.

Pressure loads under the great toe show marked reduction with the trim to fit insole of the present invention.

Heel contact duration shortens with the trim to fit insole of the present invention.

There is greater overall symmetry with the trim to fit insole of the present invention.

FIGS. 10A-11B are graphs and pressure loads of a second individual demonstrating improvements in gait and pressure loadings of a second individual wearing shoes with conventional insoles and trim to fit insoles in accordance with the present invention.

As can be seen, the greatest change was in the pressure sub great toe. The trim to fit insole of the present invention showed marked reduction in great toe pressure changes, consistent with releasing great toe joint effect.

Various changes may be made in the above invention without departing from the spirit and scope thereof.

What is claimed:

1. A trim to fit insole for insertion into a shoe having a raised metatarsal pad on the insole upper surface, wherein the raised metatarsal pad has a first region rising at a slope at an angle of 5 to 9° inboard from a medial edge of the insole board, and configured to underlie the first metatarsal head of the wearer, a second, raised top surface region configured to underlie the second to fourth metatarsal shafts of the wearer, and a third region sloping downward towards the lateral edge of the insole configured to underlie the fifth metatarsal head of the wearer, wherein the first, second and third regions cooperate to evert the first metatarsal and invert the fifth metatarsal of the wearer, wherein the raised metatarsal pad has a length of 4 cm to 8 cm, said insole further including length trim lines and width trim lines markings on a surface thereof.

2. The trim to fit insole of claim 1, Wherein the second region bridges the first and third regions.

3. The trim to fit insole of claim 1, wherein the third region is sloped at an angle of 4 to 6°.

4. The trim to fit insole of claim 1, further comprising a heel cup configured to underlie the wearer's heel, formed integrally with the foot supporting surface of the insole.

5. The trim to fit insole of claim 1, wherein the insole is left or right shoe specific.

6. The trim to fit insole of claim 1, wherein the first region is sloped at an angle of 6 to 8°.

7. The trim to fit insole of claim 1, wherein the third region is sloped at an angle of 4.5 to 5.5°.

8. A molded foot supporting device having a raised metatarsal pad on a foot supporting upper surface, wherein the raised metatarsal pad has a first region rising at a slope inboard from a medial edge of the foot supporting surface, and configured to underlie the first metatarsal head of the wearer, a second, raised top surface region configured to underlie the second to fourth metatarsal shafts of the wearer, and a third region sloping downward towards the lateral edge of the foot supporting surface configured to underlie the fifth metatarsal head of the wearer, Wherein all three regions cooperate to invert the first metatarsal of the wearer, wherein the first region is sloped at an angle of 5 to 9°, and the third region is sloped at an angle of 4 to 6°.

9. The molded foot supporting device of claim 2, wherein the second region bridges the first and third regions.

10. The molded foot supporting device of claim 8, further comprising a heel cup configured to underlie the wearer's heel, formed integrally with the foot supporting surface.

11. The molded foot supporting device of claim 8, wherein the device is left or right foot specific.

12. The molded foot supporting device of claim 8, wherein the device is selected from the group consisting of a molded sandal, a molded flip flop, a molded midsole and a molded outsole.

13. The molded foot supporting device of claim 8, wherein the first region is sloped at an angle of 6 to 8°.

14. The molded foot supporting device of claim 2, wherein the third region is sloped at an angle of 4.5 to 5.5°.

* * * * *